US006644297B1

(12) United States Patent
Brown, Jr.

(10) Patent No.: US 6,644,297 B1
(45) Date of Patent: Nov. 11, 2003

(54) SCOPE MOUNT FOR ARCHERY

(76) Inventor: Boyce W. Brown, Jr., 2188 S. Seeley Rd., Cadillac, MI (US) 49601

( * ) Notice: Subject to any disclaimer, the term of this patent is extended or adjusted under 35 U.S.C. 154(b) by 0 days.

(21) Appl. No.: 10/175,170

(22) Filed: Jun. 18, 2002

(51) Int. Cl.[7] ..... F41G 1/467
(52) U.S. Cl. ..... 124/87; 33/265
(58) Field of Search ..... 33/265; 124/87

(56) References Cited

U.S. PATENT DOCUMENTS 5,131,153 A * 7/1992 Seales ..... 33/265
5,428,901 A * 7/1995 Slates ..... 33/265
5,481,807 A * 1/1996 Ploot ..... 33/265
5,507,272 A * 4/1996 Scantlen ..... 124/87

* cited by examiner

*Primary Examiner*—John A. Ricci
(74) *Attorney, Agent, or Firm*—Donald W. Meeker

(57) ABSTRACT

A three-part, fully adjustable, left-right reversible mount attaches a Red Dot scope, or any scope with Weaver mounts, to a bow for archery. The mount is easy to use, with an approximate installation time of ten minutes, and able to accommodate a large variety of modifications according to the user's needs. It is easy to adjust, lightweight to carry, has no protruding parts to snag on trees or when climbing into tree stands, and is made from very durable materials to last the life of the bow. The mount is meant to work with all types of bows.

5 Claims, 4 Drawing Sheets

SCOPE MOUNT FOR ARCHERY

BACKGROUND OF THE INVENTION

1. Field of the Invention

The present invention relates to scope mounts for bows and, in particular, to a three-part, fully adjustable, left-right reversible mount which attaches a Red Dot scope, or any scope with weaver mounts, to a bow for archery.

2. Description of the Prior Art

For archery hunters at dusk and dawn the sight pins on a bow are hard to see. But with a Red Dot scope, as long as the hunter can see the target, the hunter will be able to see the dot in the scope. A precision scope such as the Red Dot scope requires precision mounting and adjusting.

Scope mounts for archery and Weaver mounts have been the subject of earlier patents. Of particular interest is the U.S. Pat. No. 5,893,356 to Johns which discloses a bow sight support for attachment to a bow riser. A first piece mounts to the bow and allows a second piece to be vertically adjusted. A third piece attaches to the second and allows limited horizontal and rotational motion of a user selected bracket piece. The bracket does not have to function for a Weaver mount system. This patent also discloses an adjustment means for variable distance shooting.

Furthermore, the U.S. Pat. No. 5,495,675 to Huang shows a laser sight mounting system that is adjustable in the horizontal and vertical directions. The initial bracket is mounted to the bow back. The system allows for rotational adjustment of the laser's angle of inclination and uses dovetail grooves for most of the adjustability, but does not specifically mention what grooving system attaches the laser module. In addition, the patents to Ross describe Weaver mounts. The U.S. Pat. No. 4,328,624 to Ross describes a mount in relation to pistols. The design patents to Ross show drawings of Weaver-type mounts.

What is needed is a precision mount for archery sights, using Weaver type mounts, which is easy to install and has fine tuning adjustability in all directions, and also possess lightweight and durable qualities.

SUMMARY OF THE INVENTION

An object of the present invention is to provide a bow sight bracket with a fast installation time that adjusts easily requiring only two tools: a 3/16" Allen wrench, and a 3/8" box end wrench.

Another object of the present invention is to provide reversible components so that it fits right handed or left handed bows.

An additional object of the present invention is that the three movable components may accommodate many combinations of modifications in three directions.

One more object of the present invention is that it is fabricated of machined aluminum so that it is lightweight.

An essential object of the present invention is that it holds a Red Dot Scope.

A further object of the present invention is the safety of the user and of the invention itself, since it is meant to be concealed between the bow riser and the bow string, so that when the user carries it up into a tree stand, the equipment won't hit any tree limbs that might cause the bow to be dropped or the user to loose his balance.

An added object of the present invention is that it is made of thick durable components secured together to make the sight bracket very strong.

In brief, a bracket that mounts a scope, using weaver mounts, to a bow for archery. The mount of the present invention is different from other mounts and easier to use. The mount is a three piece, easy to install, easy to adjust bracket. Part 1 is attached to the bow on the inside or outside of the riser (making it usable for right or left handed archers). Part 2 is attached to part 1 with 10–24 socket head cap screws. Part 3 attaches to part 2 with 10–24 socket head screws with lock nuts on bottom. The scope attaches to part 3. Part 2 and 3 can be adjusted right or left and up and down to sight in the scope.

The brackets are mounted to the bow riser of a compound bow so that the scope is between the bow riser and the bow string. The brackets allow horizontal and vertical adjustment of the scope.

An advantage of the present invention is that it installs quickly, in approximately ten minutes, and adjusts easily.

Another advantage of the present invention is that it fits both right and left handed bows.

An additional advantage of the present invention is that it accommodates a large variety of adjustments.

One more advantage of the present invention is that it is lightweight and easy to carry to remote hunting sites and into tree stands.

A related advantage of the present invention is that the sight bracket does not protrude from the bow, allowing it to be protected form catching on tree branches when climbing into tree stands or moving through heavily forested areas.

Yet another advantage of the present invention is its durability. It is very strong to resist breaking and is built to last the life of the bow.

Still another advantage of the present invention is that it is compatible with all bow types.

BRIEF DESCRIPTION OF THE DRAWINGS

These and other details of my invention will be described in connection with the accompanying drawings, which are furnished only by way of illustration and not in limitation of the invention, and in which drawings.

BEST MODE FOR CARRYING OUT THE INVENTION

In FIGS. 1–4, an adjustable mount for archery bow sights using a Weaver type mount is capable of mounting to both a left and a right side of a bow riser 50 for both right-handed and left-handed archers.

Figure 1:
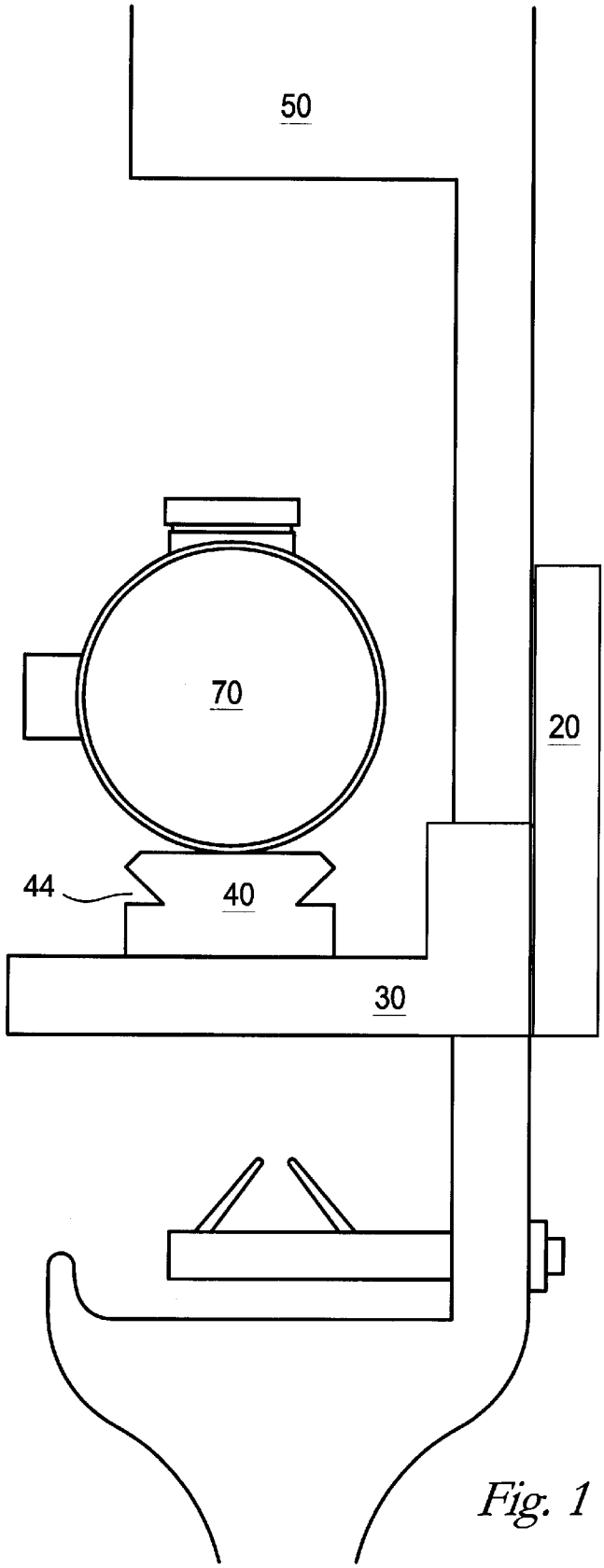
FIG. 1 is an elevational view from the archer's perspective showing the scope mounted on the bow using Brown's scope mount for archery.
Figure 2:
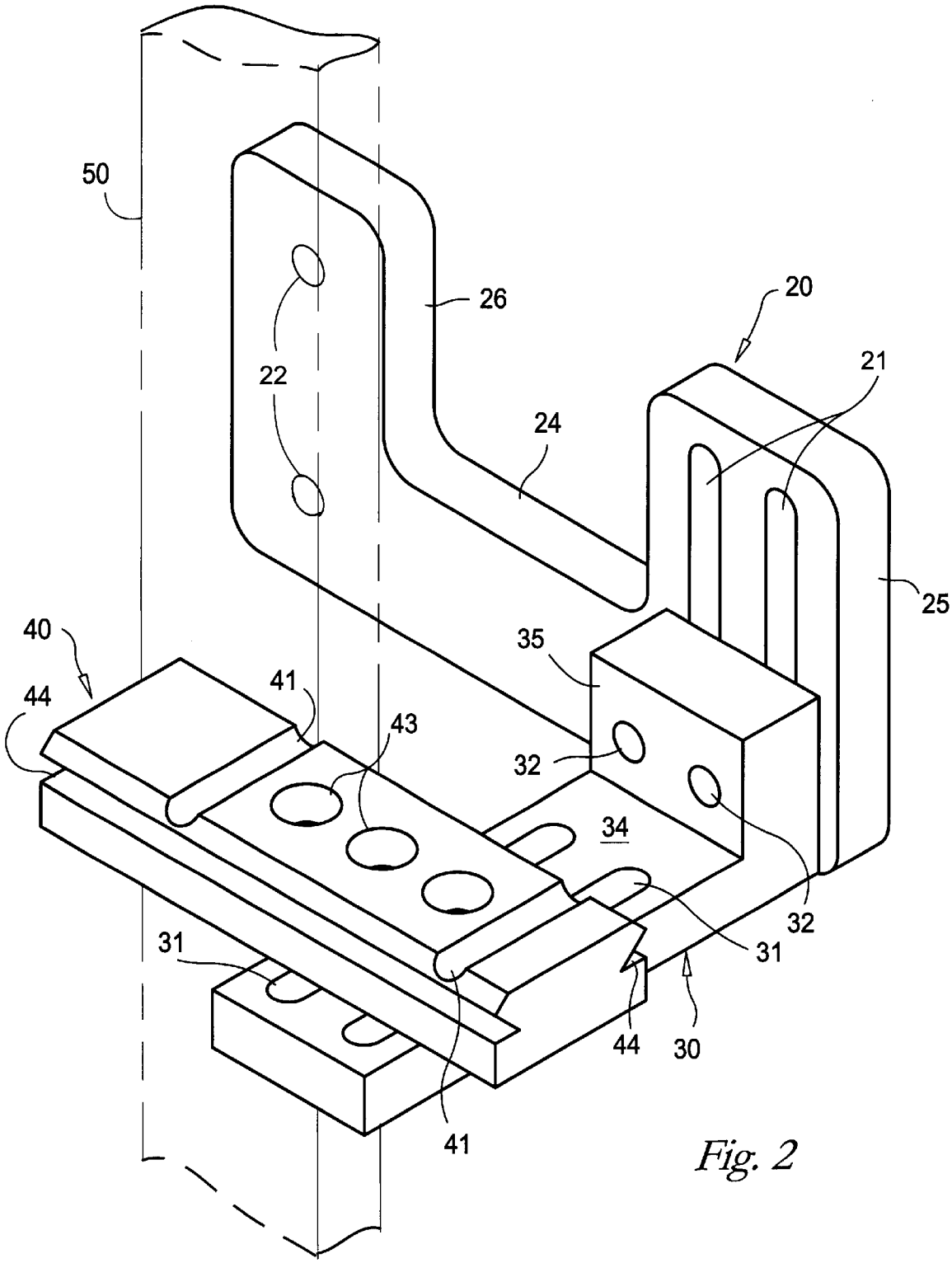
FIG. 2 is a perspective view showing the invention of claim 1 mounted on the bow for a right-handed archer.
Figure 3:
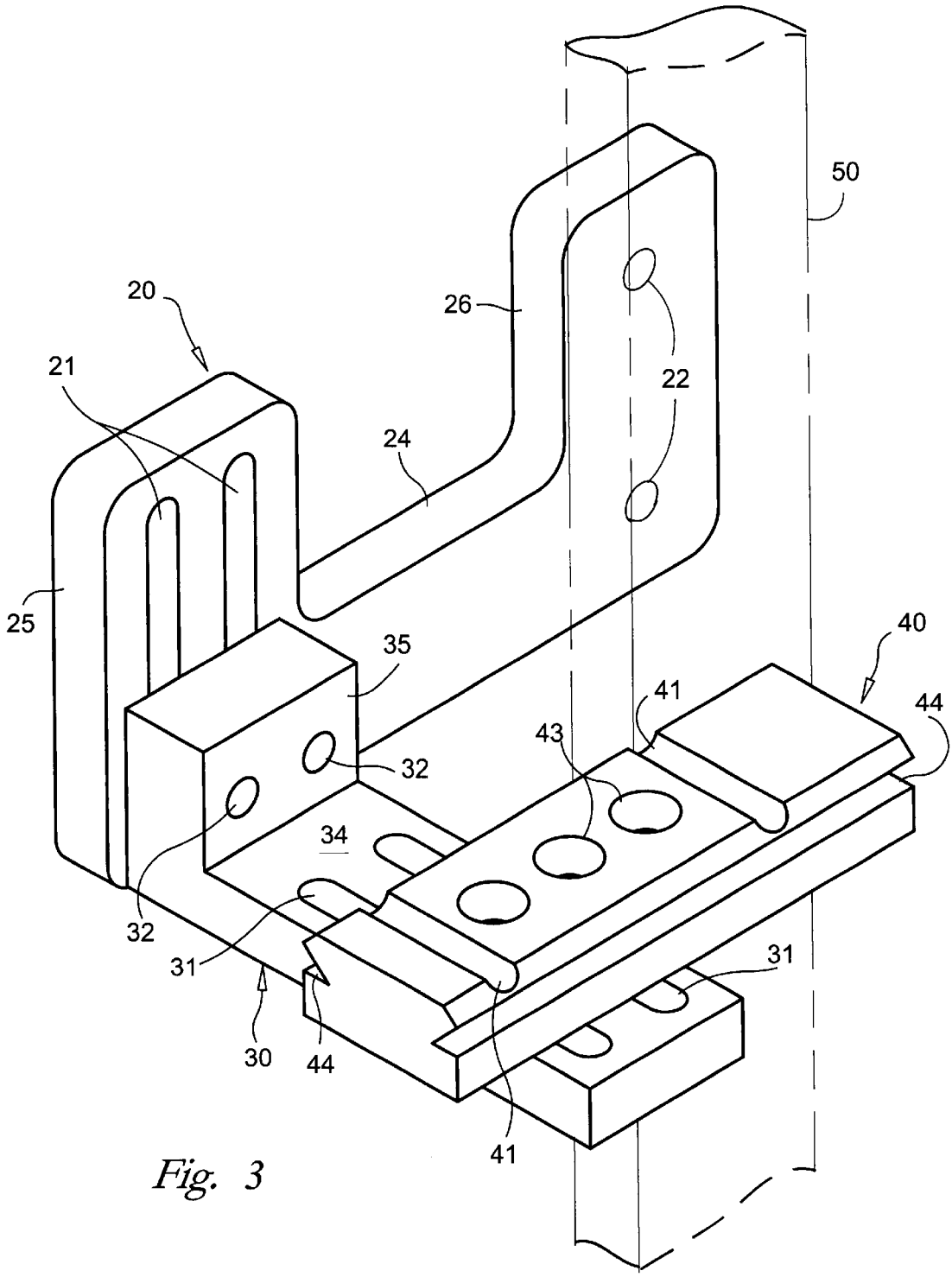
FIG. 3 is a perspective view showing the invention of claim 1 mounted on the bow for a left-handed archer.
Figure 4:
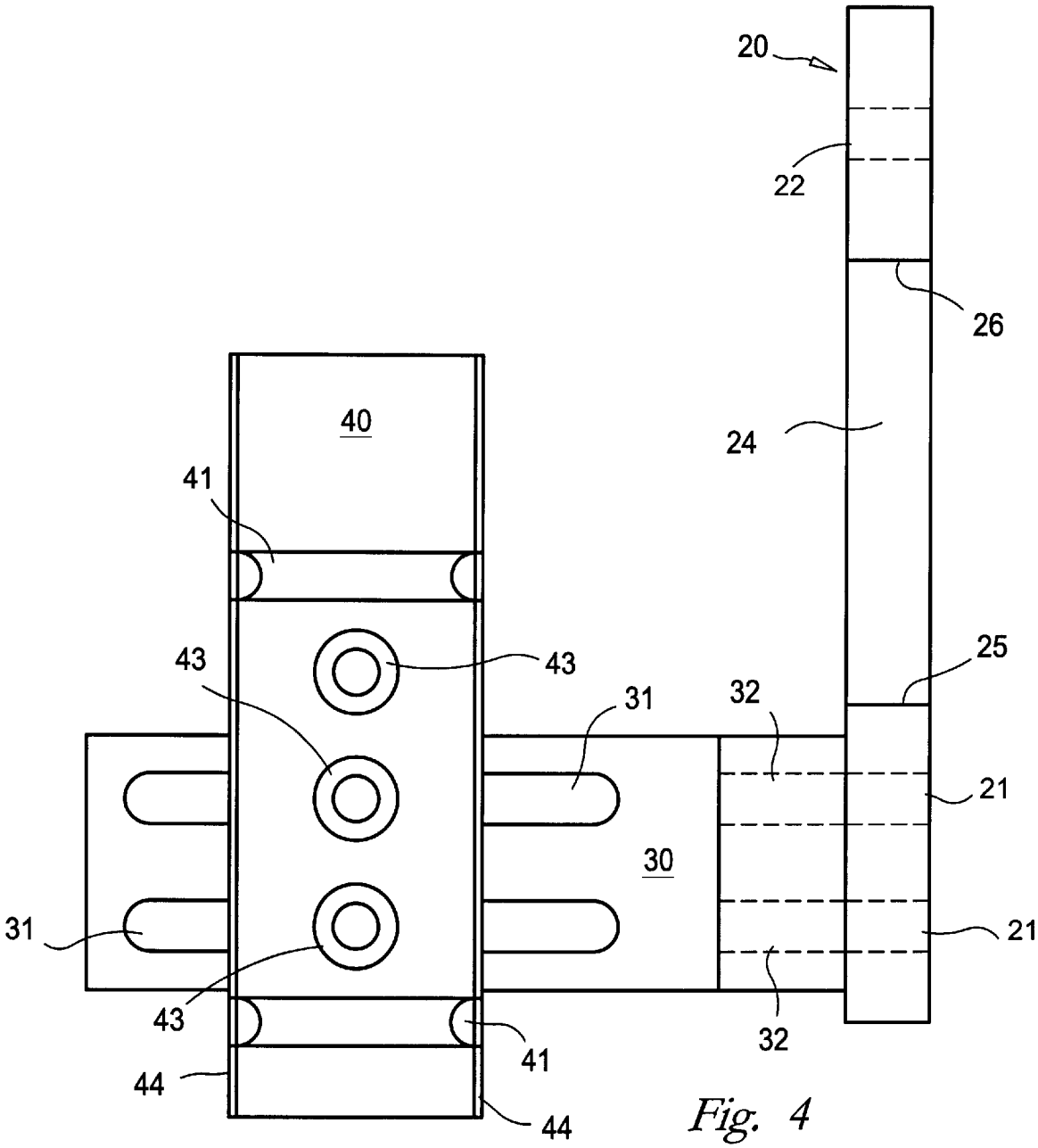
FIG. 4 is a top plan view showing the three elements of the invention aligned for mounting on the bow.

In FIGS. 1–4, a first bracket 20 is comprised of a bow mounting portion 26 capable of attaching alternately to a right side and a left side of a bow riser 50 using at least two connectors, such as screws, through vertically aligned holes 22 to create a rigid mount. A vertical bracket receiving portion 25 is spaced apart from the bow mounting portion by a horizontal arm 24 which has a pair of vertical parallel slots 21 formed through the bracket 20. The right sided mount is shown in FIG. 2 for right-handed archers, and, the left sided mount is shown in FIG. 3 for left-handed archers.

In FIGS. 1–4, a second bracket 30 is capable of being adjustably mounted to the vertical bracket receiving portion 25 of the first bracket 20, alternately to a left side (FIG. 2) and a right side (FIG. 3) of the first bracket 20, by an adjustable connector, such as a bolt through holes 32 in each of the two vertical slots 21, in the vertical bracket receiving portion 25 of the first bracket 20. The second bracket 30 is capable of being vertically adjusted relative to the first bracket 20 by sliding in the slots 21. The second bracket 30 possess a horizontal bracket receiving portion 34 having a pair of horizontal spaced parallel slots 31 formed therethrough.

In FIGS. 1–4, a third bracket 40 is capable of being adjustably mounted to the horizontal bracket receiving portion 34 of a second bracket 30 by an adjustable connector such as a bolt or screw through two of the holes 43 and into each of the two horizontal slots 31 of the second bracket 30. The third bracket 40 is capable of being horizontally adjusted relative to the second bracket 30 by sliding in the slots 31. The third bracket 40 possesses a bow sight receiving portion with a pair of V-shaped slotted slide means 44 and transverse slots 41 capable of receiving a bow sight 70 mounted adjustably thereon. The third bracket 40 is capable of receiving an archery scope 70 having a Weaver type connection.

The brackets 20, 30, 40 are machined from machinable aluminum, nylon, other machinable material.

It is understood that the preceding description is given merely by way of illustration and not in limitation of the invention and that various modifications may be made thereto without departing from the spirit of the invention as claimed.

What is claimed is:

1. An adjustable mount for archery bow sights using a Weaver type mount, the adjustable mount being capable of mounting to both a left and a right side of a bow riser for both right-handed and left-handed archers, the adjustable mount comprising:

a first bracket comprising a bow mounting portion capable of attaching alternately to a right side and a left side of a bow riser with at least two connectors for a rigid mount, and a vertical bracket receiving portion spaced apart from the bow mounting portion, and having a pair of vertical parallel slots formed therethrough;

a second bracket capable of being adjustably mounted to the vertical bracket receiving portion of the first bracket alternately to a left side and a right side of the first bracket by an adjustable connector in each of the two vertical slots, so that the second bracket is capable of being vertically adjusted relative to the first bracket, the second bracket having a horizontal bracket receiving portion having a pair of horizontal spaced parallel slots formed therethrough;

a third bracket capable of being adjustably mounted to the horizontal bracket receiving portion by an adjustable connector in each of the two horizontal slots, so that the third bracket is capable of being horizontally adjusted relative to the second bracket, the third bracket having a bow sight receiving portion with a slotted slide means oriented in a reversible forward and rearward direction, the slotted slide means capable of receiving a bow sight mounted adjustably thereon.

2. The adjustable mount of claim 1 wherein the slotted slide means comprises an elongated element having a notch along its length on each of two sides adjacent to a top surface of the slotted slide means, the slotted slide means being capable of receiving an archery scope having a Weaver type connection.

3. The adjustable mount of claim 2 wherein the slotted slide means further comprises two spaced transverse slots in the top surface, the slots being capable of receiving elements from the archery scope.

4. The adjustable mount of claim 1 wherein the bow mounting portion of the first bracket comprises a rigid element having two opposing flat vertical faces each capable of engaging a side of a bow riser, and having at least two vertically spaced openings therethrough for receiving connectors capable of engaging the bow riser.

5. The adjustable mount of claim 1 wherein the brackets are machined from machinable aluminum.

* * * * *